United States Patent [19]

Arceneaux, Jr.

[11] 4,455,760

[45] Jun. 26, 1984

[54] TRIANGLE

[76] Inventor: Milton G. Arceneaux, Jr., 4434 Herrmann St., Metairie, La. 70002

[21] Appl. No.: 514,086

[22] Filed: Jul. 15, 1983

[51] Int. Cl.[3] ..... B43L 7/00

[52] U.S. Cl. ..... 33/482; 33/174 N

[58] Field of Search ..... 33/482, 474, 1 K, 174 N, 33/174 B, 476, 477

[56] References Cited

U.S. PATENT DOCUMENTS

| | | | |
|---|---|---|---|
| 217,967 | 7/1879 | White | 33/482 |
| 697,594 | 4/1902 | Alteneder | 33/474 |
| 1,287,440 | 12/1918 | Rivkin | 33/474 |
| 2,593,914 | 4/1952 | Palitto | 33/482 |
| 2,610,407 | 9/1952 | McQuaid, Sr. | 33/474 |
| 4,404,753 | 9/1983 | Klok | 33/482 |

FOREIGN PATENT DOCUMENTS

| | | | |
|---|---|---|---|
| 1357 | of 1893 | United Kingdom | 33/482 |

*Primary Examiner*—Willis Little

*Attorney, Agent, or Firm*—Diller, Ramik & Wight

[57] ABSTRACT

This disclosure is directed to a triangle for drafting isometric drawings, the triangle being a generally planar thin body having a periphery bounded by first, second and third edges defining first, second and third corners with the first two corners setting-off an included angle of 30 degrees and the third corner setting off an included angle of 120 degrees and at least one opening within the periphery of the triangle having at least one straight edge portion which sets off with the most adjacent body edge an included angle of thirty degrees opening away from the 120 degree corner and the last-mentioned edge of the opening being disposed normal to the most remote edge of the 120 degree corner whereby during the drafting of isometric drawings, the triangle need not be inverted, flipped or rotated or the drawing position changed or another conventional triangle utilized to draft isometric drawings.

24 Claims, 5 Drawing Figures

FIG.1
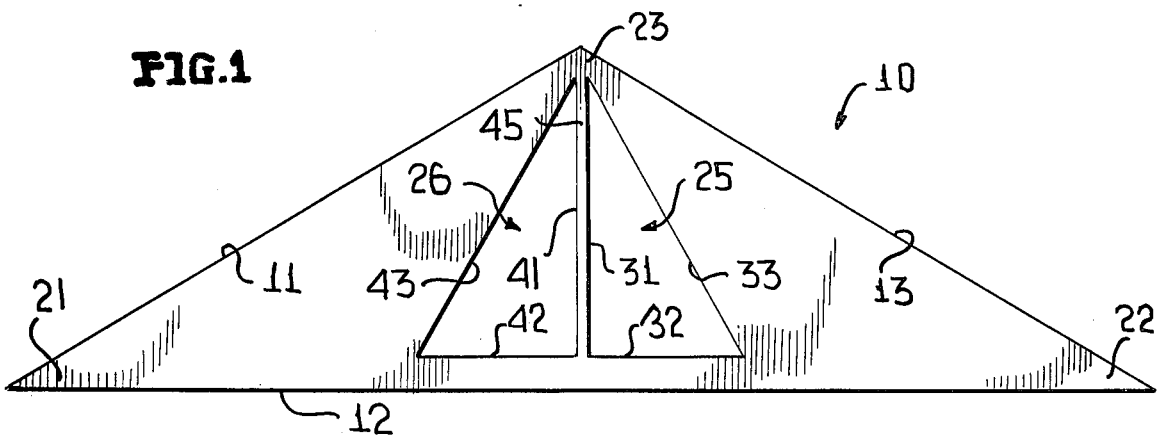
FIG.2
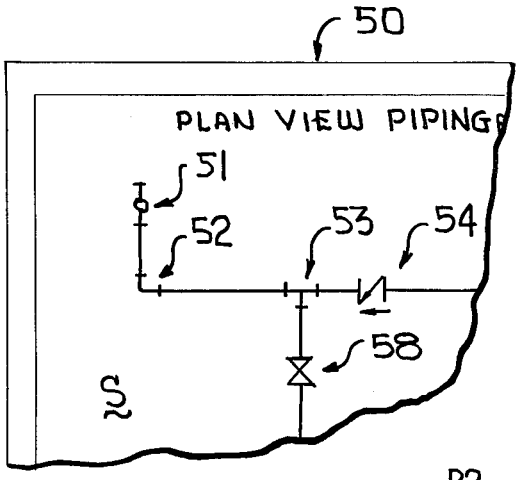
FIG.3
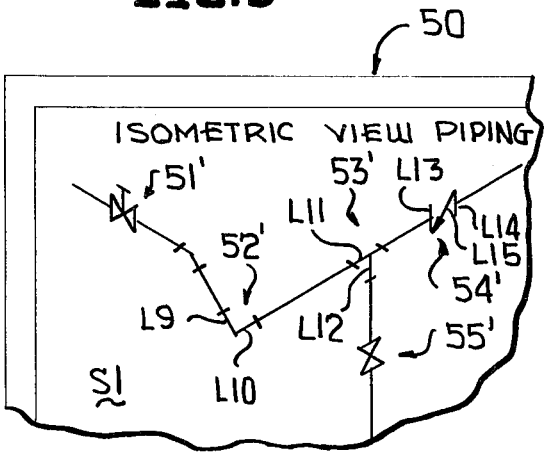
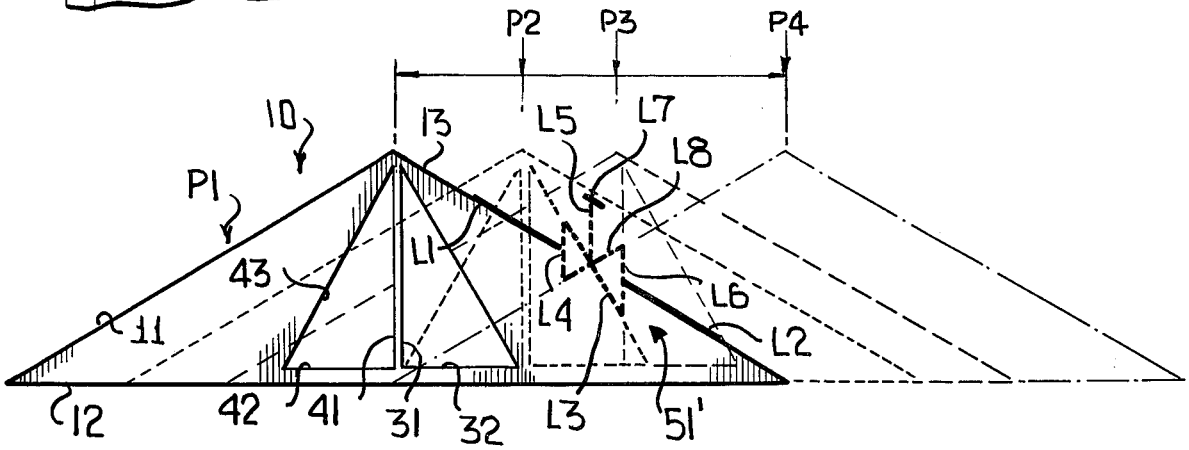
FIG.4
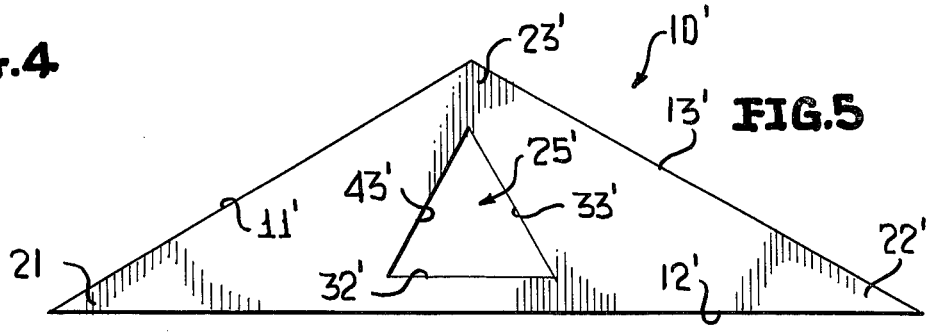
FIG.5

TRIANGLE

This invention is directed to a triangle for drafting isometric drawings by moving the triangle from side-to-side to achieve any isometric alignment required in the absence of either (1) rotating or otherwise manipulating the triangle, (2) reversing the surface of the triangle to the drawing, (3) utilizing a second triangle in conjunction with a first triangle, and/or (4) manipulating the paper. In this fashion, the triangle of this invention makes the preparation of isometric drawings simple and quick, particularly in drawing valves and fittings for industrial piping systems relating to the petro-chemical and related fields. However, the invention is not limited to the latter and is equally and readily utilized in any environment wherein isometric drawings must be made on a relatively continuous and repetitive basis.

Essentially, the present invention is directed to a triangle formed as a generally thin planar body having a periphery bounded by three edges with a first and second of the edges defining a first corner setting-off an included angle of 30 degrees, the second and a third of the edges defining a second corner setting-off an included angle of 30 degrees, and the first and third edges defining a third corner setting-off an included angle of 120 degrees, and to this extent the triangle is conventional, but in keeping with the invention at least one opening is provided within the periphery of the triangle body with the opening being defined by first, second and third edges, the opening third edge being adjacent the body third edge and setting-off an included angle of 30 degrees opening away from the third corner, and the opening third edge being normal to the most adjacent or first edge of the triangle body whereby the opening third edge can be used to form isometric drawings simply by manipulating the triangle in a side-to-side fashion without rotating or otherwise manipulating the triangle, reversing the surface of the triangle to the paper, using a second triangle, or manipulating the paper.

In further accordance with this invention, the triangle may include at least one additional edge which is normal to the edge of the triangle spanning the 30 degree corners to form lines normal to the horizontal during the drafting of an isometric drawing without the manipulation of the triangle or paper heretofore noted.

Yet another object of this invention is to provide a novel triangle as aforesaid wherein either one or two openings are provided, and in each case the single opening or the two openings define edges which when projected toward the associated edge of the 120 degree corner include therewith a 90 degree angle.

With the above and other objects in view that will hereinafter appear, the nature of the invention will be more clearly understood by reference to the following detailed description, the appended claims and the several views illustrated in the accompanying drawings.

IN THE DRAWINGS:

FIG. 1 is a top view of a triangle of this invention specifically adapted for drafting isometric drawings, and illustrates two triangular openings within the periphery of a 30–30–120 degree triangle.

FIG. 2 is a fragmentary top plan view, and illustrates hydraulic symbols on a sheet of drawing.

FIG. 3 is a fragmentary top plan view, and illustrates isometric hydraulic symbols on a drawing corresponding to those of FIG. 2.

FIG. 4 is a top plan view of the triangle of FIG. 1 in reduced scale, and in dash lines shows three positions thereof, and illustrates the manner in which a control valve of FIG. 3 is produced by the triangle simply by shifting the same in a side-to-side fashion.

FIG. 5 is a perspective view of another triangle, and illustrates a single triangular opening within a 30–30–120 degree triangle.

A novel triangle constructed in accordance with this invention specifically adapted for isometric drawings is fully illustrated in FIG. 1 and is generally designated by the reference numeral 10.

The triangle 10 is formed of a generally thin, planar body of plastic or like material having a periphery (unnumbered) bounded by three edges, namely, a first edge 11, a second edge 12, and a third edge 13.

The first and second edges 11, 12, respectively, define a first corner 21 setting-off an included angle of 30 degrees.

The second and third edges 12, 13, respectively, define a second corner 22 setting-off an included angle of 30 degrees.

The first and third edges 11, 13, respectively, set-off a third corner 23 having an included angle 120 degrees.

The first edge 11 is common to the first and third corners 21, 23, respectively; the second edge 12 is common to the corners 21, 22, respectively; and the third edge 13 is common to the second and third corners 22, 23, respectively.

Means 25, 26 are provided within the periphery of the triangle 10 for defining a pair of openings with the opening 25 including first, second and third edges 31, 32 and 33, respectively; and the opening 26 being defined by first, second and third edges 41, 42 and 43, respectively.

The edges 32, 42 are in alignment and are parallel to the edge 12, while the edges 31, 41 are likewise in parallel spaced relationship to each other to define therebetween a narrow strip 45. The edges 31, 41 are also normal to the edges 32, 42, and to the edge 12.

The straight edge or edge portion 33 and the most adjacent edge 13 which in part defines the 120 degree corner 23 defined therebetween an acute angle (30 degrees) opening in a direction away from the 120 degree corner 23.

Likewise, the straight edge or straight edge portion 43 and the most adjacent edge 11 which in part defines the 120 degree corner 23 defined therebetween an acute angle opening in a direction away from the 120 degree corner.

Due to the latter two acute angles defined between the edges 13, 33 and the edges 11, 43, the edges 33, 43 are disposed normal to the edges 11, 13, respectively. Thus, by visualizing the edge 33 projected upwardly in FIG. 1 its upward projection defines a 90 degree angle with the edge 11, whereas a like upward projection of the edge 43 defines a 90 degree angle with the edge 13. The latter relationships permit the triangle 10 to be utilized to make isometric drawings in the manner to be described immediately hereinafter.

Reference is now made to FIG. 2 which illustrates a conventional drafting table or board 50 upon which lies a sheet of paper S. The sheet of paper S has drawn thereon utilizing typical hydraulic symbols a control valve 51, and elbow 52, a T-fitting 53, a check valve 54 and a globe valve 55.

FIG. 3 illustrates the same drafting board 50 with a sheet S1 thereon upon which has been drawn the isometric symbols corresponding to those shown in plan view in FIG. 2, and hence the same have been identically numbered except primed. All of the lines and symbols 51' through 55' on the sheet S' of FIG. 3 can be applied thereto by utilizing the triangle 10 and moving the same only in a side-to-side fashion without in anyway otherwise manipulating the triangle 10 or utilizing other triangles therewith in a manner diagrammatically illustrated in FIG. 4 to which attention is now directed.

In FIG. 4 the triangle 10 is shown in position P1 with its lower edge 12 suitably guided upon, for example, a T-square such that the edge 12 can be guided to slide the triangle 10 from the first position P1 to successive positions P2, P3 and P4.

At position P1 lines L1, L2 are drawn along the edge 13 of the triangle 10. The lines L1, L2 corresponds to the unnumbered lines to either side of the isometrically illustrated control valve 51' of FIG. 3.

The triangle 10 is then shifted to position P2 at which the line L3 is drawn along the edge 33 of the opening 25.

The triangle is then shifted in three increments between position P2 to position P3 at which three positions the lines L4, L5 and L6 are drawn along either of the edges 31, 41. At position P3 the edge 31 is illustrated being utilized to draw the line L6.

The line L7 can be drawn during the time that the triangle is shifted from position P1 to position P2 along the edge 13 or during the shifting of the triangle 10 from position P2 to position P3 once again utilizing the same edge 13 as a guide.

Finally, the triangle 10 is moved from position P3 to position P4 and the line L8 is drawn utilizing the edge 11, thereby completing the isometrically illustrated control valve 51' without, as was heretofore noted, in any fashion doing anything other than moving the triangle 10 sidewise.

From the latter described utilization of the triangle 10, it is believed apparent the manner in which others of the hydraulic symbols 52' through 55' are drawn. As an example, the elbow 52' can be drawn by simply utilizing the edge 33 to form a line L9, sliding the triangle 10 to the right, and utilizing the edge 11 to draw a line L10.

In a similar fashion, the same edge 11 of the triangle 10 can be used to draw a line L11 of the T-fitting 53' and by simply sliding the triangle 10 in the manner heretofore described either of the edges 31, 41 can be utilized to form the line L12.

Continuing with a similar sliding motion imparted to the triangle 10, lines L13 and L14 can be drawn utilizing either of the edges 31, 41, while a line L15 of the symbol 54' is formed by the edge 43.

The same techniques are readily apparent relative to the formation of the isometric globe valve 55' which will simply not be described since the same is quite readily apparent from the description heretofore made relative to the drafting of the control valve of FIG. 4.

Another triangle constructed in accordance with this invention specifically adapted for similarly drafting isometric drawings is shown in FIG. 5 and is generally designated by the reference numeral 10'. Structure corresponding to that of the triangle 10 has simply been identified by identical, though primed, reference characters, it being noted that the major difference between the two triangles is that the triangle 10 includes two openings 25, 26 with a bridging segment 45 therebetween whereas the triangle 10' includes but a single opening 25' defined by straight edges 32', 33' and 43'. However, just as in the case of the triangle 10, the triangle 10' includes two pairs of adjacent straight edges 13', 33' and 11', 43' which respectively set off an acute angle opening away from the 120 degree corner 23'. Furthermore, the edges or straight edge portions 33', 43' are normal to the respective edges 11' and 13'. Due to the latter arrangement, the triangle 10' can be utilized just as described relative to the triangle 10 except, of course, in the absence of the edges 31, 41, one could not make such lines as the lines L12 through L13 of FIG. 30 with the triangle 10'.

Although only a preferred embodiment of the invention has been specifically illustrated and described herein, it is to be under-stood that minor variations may be made in the apparatus without departing from the spirit and scope of the invention, as defined in the appended claims.

What is claimed is:

1. A triangle specifically adapted for drafting isometric drawings comprising a generally planar body having a periphery bounded by three edges with adjacent edges setting-off an associated corner, two of said corners having an included angle of 30 degrees and a remaining corner having an included angle of 120 degrees, means within said periphery for forming at least one opening defined by an edge having at least one straight edge portion, said one straight edge portion and the most adjacent of the edges defining said 120 degree corner defining therebetween an acute angle opening in a direction away from said 120 degree corner, and said one straight edge portion being normal to the most remote of the edges defining said 120 degree corner.

2. The triangle as defined in claim 1 wherein said acute angle is 30 degrees.

3. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, and said second straight edge portion being normal to the most remote of the edges defining said 120 degree corner.

4. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, said second straight edge portion being normal to the most remote of the edges defining said 120 degree corner, and at least one of said acute angles being 30 degrees.

5. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, said second straight edge portion being normal to the most remote of the edges defining said 120 degree corner, and each of said acute angles being 30 degrees.

6. The triangle as defined in claim 1 wherein said opening edge includes a second straight edge portion disposed normal to the edge between said 30 degree corners.

7. The triangle as defined in claim 1 including means within said periphery for forming another opening defined by another edge having at least one straight edge portion, said first-mentioned opening edge includes a second straight edge portion, and said first-mentioned opening edge second straight edge portion and said another edge one straight edge portion being in parallel relationship to each other.

8. The triangle as defined in claim 1 including means within said periphery for forming another opening defined by another edge having at least one straight edge portion, said first-mentioned opening edge includes a second straight edge portion, said first-mentioned opening edge second straight edge portion and said another edge one straight edge portion being in parallel relationship to each other, and disposed normal to the edge between said 30 degree corners.

9. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, said second straight edge portion being normal to the most remote of the edges defining said 120 degree corner, and said at least one opening is a single opening.

10. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, said second straight edge portion being normal to the most remote of the edges defining said 120 degree corner, and said at least one opening is a pair of openings.

11. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, said second straight edge portion being normal to the most remote of the edges defining said 120 degree corner, said at least one opening is a single opening, said opening edge includes a third straight edge portion, and said third straight edge portion is in parallel relationship to the edge between said 30 degree corners.

12. The triangle as defined in claim 1 wherein said opening edge includes a second straight edge portion, said second straight edge portion and the most adjacent of the body edges defining said 120 degree corner defining therebetween an acute angle opening in a direction away from said 120 degree corner, said second straight edge portion being normal to the most remote of the edges defining said 120 degree corner, said at least one opening is a single opening, said opening edge includes a third straight edge portion, said third straight edge portion is in parallel relationship to the edge between said 30 degree corners, and adjacent pairs of said one, second and third straight edge portions set-off corners of said opening with each corner including an angle of 60 degrees.

13. The triangle as defined in claim 1 wherein said opening edge includes a second straight edge portion disposed normal to the edge between said 30 degree corner.

14. The triangle as defined in claim 1 wherein said opening edge includes a second straight edge portion disposed normal to the edge between said 30 degree corners, and a third edge portion in parallel relationship to the edge between said 30 degree corners.

15. The triangle as defined in claim 1 including means within said periphery for forming another opening defined by another edge having at least one straight edge portion, and said another edge straight edge portion being disposed normal to the edge between said 30 degree corners.

16. The triangle as defined in claim 15 wherein said one opening edge includes a second straight edge portion, and said second straight edge portion and another edge straight edge portion are in parallel relationship to each other.

17. The triangle as defined in claim 16 wherein said another edge has a second straight edge portion, said another edge second straight edge portion and the most adjacent of the body edges defining said 120 degree corner defining therebetween an acute angle opening in a direction away from said 120 degree corner, and said another edge second straight edge portion being normal to the most remote of the edges defining said 120 degree corner.

18. The triangle as defined in claim 17 wherein each edge includes at least one further straight edge portion, and said further straight edge portions are disposed in parallel relationship to the edge between said 30 degree corners.

19. A triangle specifically adapted for drafting isometric drawings comprising a generally planar body having a periphery bounded by three edges, a first and second of said edges defining a first corner setting-off an included angle of 30 degrees, said second and a third of said edges defining a second corner setting-off an included angle of 30 degrees, said first and third edges defining a third corner setting-off an included angle of 120 degrees, said first edge being common to said first and third corners, said second edge being common to said first and second corners, said third edge being common to said second and third corners, means for defining an opening within said periphery, said opening being defined by first, second and third edges, said opening third edge being adjacent said body third edge and setting-off therewith an included angle of 30 degrees opening away from said third corner, and said opening third edge being normal to said body first edge.

20. The triangle as defined in claim 19 wherein said opening first edge is normal to said body second edge.

21. The triangle as defined in claim 19 wherein said opening first edge is normal to said body second edge and said opening second edge is in parallel relationship to said body second edge.

22. The triangle as defined in claim 19 wherein said opening first edge is adjacent said body first edge and sets-off therewith an included angle of 30 degrees opening away from said third corner, said opening first edge is normal to said body third edge, said opening and body second edges are in parallel relationship, and adjacent pairs of said opening edges each define an included angle of 60 degrees.

23. The triangle as defined in claim 21 including means for defining another opening within said periphery, said another opening being defined by first, second and third edges, said another opening third edge being adjacent said body first edge and setting-off therewith an included angle of 30 degrees opening away from said third corner, said another opening third edge being normal to said body third edge, and said openings first edges being in spaced parallel relationship to each other and normal to said body second edge.

24. The triangle as defined in claim 23 wherein said openings second edges are aligned.

* * * * *